United States Patent [19]

LeBlanc et al.

[11] Patent Number: 4,558,219

[45] Date of Patent: Dec. 10, 1985

[54] METHOD AND APPARATUS FOR DETERMINING FLOW CHARACTERISTICS WITHIN A WELL

[75] Inventors: Aladain J. LeBlanc; Robert A. Turney, both of Houston, Tex.

[73] Assignee: Dresser Industries, Inc., Dallas, Tex.

[21] Appl. No.: 395,198

[22] Filed: Jul. 6, 1982

[51] Int. Cl.[4] ..... G01V 5/08

[52] U.S. Cl. ..... 250/260; 250/259

[58] Field of Search ..... 250/259, 260; 175/42

[56] References Cited

U.S. PATENT DOCUMENTS

| | | | |
|---|---|---|---|
| 2,385,378 | 9/1945 | Piety | 250/260 |
| 3,766,388 | 10/1973 | Greaney | 250/266 |
| 3,784,828 | 1/1974 | Hayes . | |
| 4,166,215 | 8/1979 | Anderson | 250/260 |
| 4,166,216 | 8/1979 | Cubberly, Jr. | 250/260 |

*Primary Examiner*—Alfred E. Smith
*Assistant Examiner*—Carolyn E. Fields
*Attorney, Agent, or Firm*—Patrick H. McCollum; Richard M. Byron

[57] ABSTRACT

An elongated body member adapted to traverse a well contains a chamber for holding a quantity of a tracer element to be injected into the well. A radially extendable arm is pivotally attached to the body member and is adapted to be extended and retracted by a first drive system within the body member. A nozzle is coupled to the arm with a path of fluid communication provided between the chamber and the nozzle such that a second drive system within the body member may cause the tracer element to traverse such path and be released into the well fluid flow column from a location adjacent to the body member and preferably to be released in a generally longitudinal direction relative to the well. One or more detectors within the body member suitable for detecting the tracer element are utilized to determine the locations and/or flow velocity of the tracer element and therefore of the well fluid.

8 Claims, 9 Drawing Figures

FIG. 2A
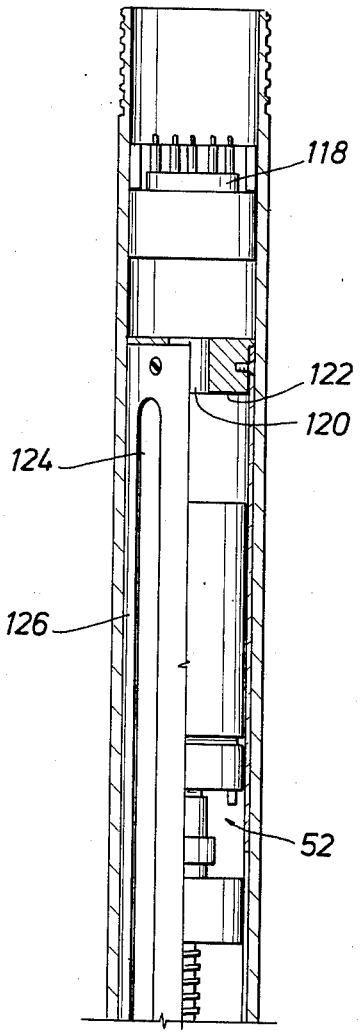
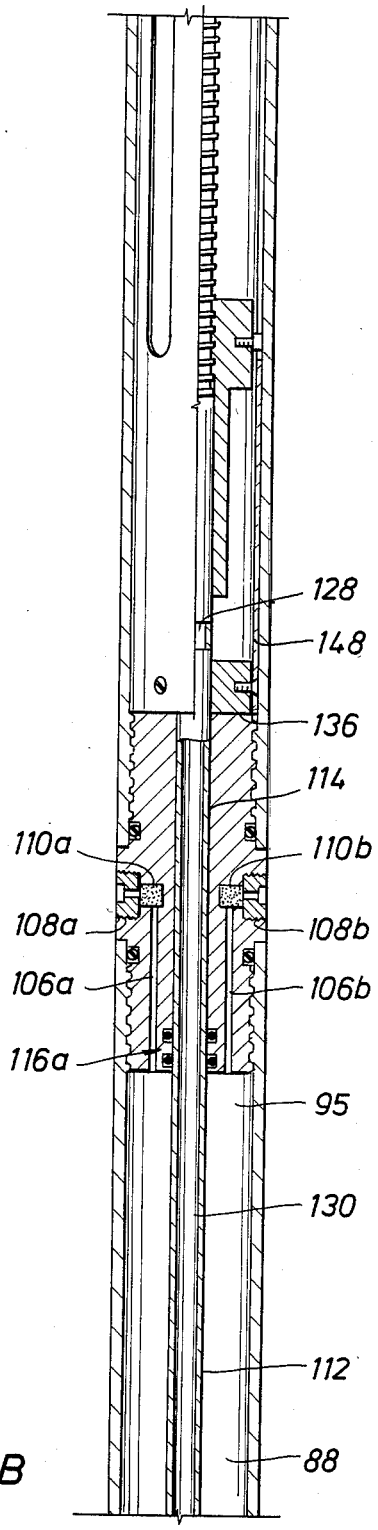
FIG. 2B 42
140
66
84
62
60
72
74
76
78
80

92
152
148
36
94
151
156
150
158
160
144
142
82
146
140

METHOD AND APPARATUS FOR DETERMINING FLOW CHARACTERISTICS WITHIN A WELL

BACKGROUND OF THE INVENTION

This invention relates generally to methods and apparatus for well logging and more specifically relates to methods and apparatus for injecting a tracer element into the fluid flow within a well to assist in the determination of parameters concerning the movement of such fluid flow.

Wells drilled for use in the production of oil or gas may be utilized either as producing wells, from which the oil or gas is obtained, or as injection wells, through which fluids, such as polymer compounds or salt water, are forced into the earth formations surrounding the well to force the oil or gas through the formations to thereby stimulate production in nearby wells. Wells may often be drilled as producing wells and subsequently converted to use as injection wells when such change in usage becomes economically preferable.

In a producing well, the oil or gas may enter the well from one or more depth horizons or zones within the earth formations surrounding the well. When the oil or gas is being produced from more than one zone it is desirable to determine how much of the fluid is being produced from each zone. This determination may be made by measuring the velocity of the well fluid at various depth locations within the well, preferably at locations between the known producing zones. From such fluid velocity measurements and knowledge of both the diameter of the well at each depth location and of the diameter of the logging instrument used to measure the fluid velocity, the volumetric flow rate of the well fluid at each depth location may be determined, thereby facilitating a determination of the proportional contribution of each producing zone to the total flow rate of the well.

An analogous but reverse situation is presented in the case of injection wells. When the polymers, salt water, or other fluids are being injected, or pumped, into the well, it is desirable to determine the proportion of the injection fluid which is entering each zone within the well so as to determine if the desired zones are receiving the injection fluid. By measuring the velocity of the injection fluid and by determining the fluid flow rate therefrom at various depth locations within the well, the proportion of the injection fluid entering each zone may be determined.

One means which has been utilized by the oil and gas industry to make such fluid velocity measurements, and in turn such flow rate determinations, has been to inject a tracer element, such as a radioactive isotope, into a well fluid flow and to measure the time required for the tracer element to traverse a known distance within the well. In the case of a radioactive tracer this may be accomplished by injecting the tracer element from a logging instrument upstream in the fluid flow from a pair of suitable radiation detectors, such as geiger counter tubes or scintillation counters, spaced a known fixed distance apart along the longitudinal axis of the logging instrument. The time between the passing by the tracer element of the first detector to the passing of the second detector may then be utilized to determine the velocity of the well fluid. This tracer injection method of flow rate determination is particularly useful in production wells with low flow rates and in injection wells where polymers are being injected because low flow rates and/or relatively high viscosity fluids, such as polymers, often cause other types of flow meters to yield less than optimal data in flow rate measurements.

The injection of a tracer element into a well fluid flow is also used by the oil and gas industry in logging operations to determine the location of fluid flow in wells rather than the rate of the fluid flow. This type of logging operation also aids in determining zones into which fluid flows in injection wells and may additionally be utilized in both production and injection wells to determine and locate mechanical breakdowns within the well such as holes or leaks in the well casing or channeling within the cement or earth formations surrounding the casing. In this type of logging operation, the tracer element, again preferably a radioactive tracer, is injected into the well fluid flow and one or more suitable detectors of the tracer are traversed through at least a portion of the well to determine the location of the tracer. Preferably, a plurality of such traversals are made over selected increments of time so as to monitor the travel of the tracer to aid in the determination of the presence of any channelling as described earlier herein.

The tracer element may be injected into the well fluid in the form of a globule or blob or it may be preferable to inject the tracer element into the well fluid such that the tracer element disperses in a cloud-like diffusion within the well fluid. Regardless of the form in which the tracer element is to be injected into the well fluid, in both types of logging operations described earlier herein it is desirable to inject the tracer element such that the tracer element is moved and carried by the well fluid in a manner generally indicative of the movement of the well fluid. Such manner of injection is complicated by the fact that all of the fluid flowing within the well does not travel at a uniform velocity. The general tendency is that the fluid near the sidewalls or casing of the well and fluid adjacent a logging instrument placed within the well will flow at a significantly lower velocity than will the fluid flowing near the center of the well bore. Because this fluid flowing near the center of the well bore typically exhibits the maximum velocity at any one depth horizon within the well and, correspondingly, the maximum volumetric flow rate at such depth horizon, it is optimal to inject the tracer element into the fluid flowing proximate the effective center of the well bore.

Apparatus commonly used in the oil and gas industry for injecting tracer elements into the well fluid have typically injected the tracer element in a generally lateral direction relative to the longitudinal axis of the well bore, such injection typically being accomplished by forcing the tracer element through one or more jets or nozzles located on the periphery of a logging instrument. Further, the logging instrument in such injection operations has typically been centralized along the longitudinal axis of the well bore. When the logging instrument is centralized within the well there is an annulus between the outer diameter of the logging instrument and the inner diameter of the well bore. The maximum flow rate past the logging instrument will typically be found proximate an area located along the radial center of the annulus, with the lowest flow rates typically being found in areas adjacent the exterior of the logging instrument and adjacent the inner perimeter of the well. Dependent upon the outer diameter of the logging instrument and the inner diameter of the well or casing, the annulus may range from approximately one inch to over a foot in radial dimension. Additionally, because the inner diameter of the well bore or casing may differ over the depth of the well, annuli of several sizes may be encountered within a single well. It can, therefore, be appreciated that with the described commonly used logging instruments which eject the tracer element laterally into the well fluid, it can be virtually impossible to continually accurately place the tracer element into the maximum flow of the well fluid at the center of the described annulus. It can also be appreciated that if such tracer element is not placed proximate the cross-sectional center of the area of fluid flow, the uneven velocities within the fluid flow may lead to less than optimal data regarding the flow rates and areas of penetration of the fluid flow.

Accordingly, the present invention overcomes the deficiencies of the prior art by providing a method and apparatus whereby tracer elements may be accurately and repeatedly placed in a desired proportional location across the fluid flow column within a well and by which characteristics of the movement of such fluid may be determined.

SUMMARY OF THE INVENTION

A tracer injector adapted to place a quantity of a tracer element longitudinally into a fluid flow column within a well is coupled to one or more appropriate detectors of such tracer elements forming an instrument adapted to traverse the well to a plurality of depth horizons therein. In a preferred embodiment the tracer injector includes an elongated body member to which is attached an articulating arm assembly designed to extend generally laterally relative to the body member. A drive mechanism within the body member extends and retracts the articulating arm assembly in response to command signals generated within electronic control circuitry at the earth's surface. At a depth horizon at which a quantity of tracer element is to be injected, the articulating arm assembly will preferably be extended to a point at which the assembly has made contact with a side of the well and through force exerted therein has fully biased the body member against the opposite side of the well.

Again, in a preferred embodiment, coupled to the articulating arm assembly is a nozzle for releasing the tracer element into the fluid flow column. A reservoir or chamber for holding a quantity of the tracer element is contained within the body member and placed in fluid communication with the nozzle by means of passages and fluid couplings in the body member and the articulating arm assembly. A piston in the chamber is moved therein by a second drive mechanism, such movement also occurring in response to command signals from electronic control circuitry at the earth's surface. As the piston moves within the chamber, the tracer element contained therein is forced through the passages and fluid couplings to reach the nozzle where the fluid is injected from the nozzle into the fluid flow column. Due to the radial movement, relative to the body member, of the arm to which the nozzle is attached, and the fixed placement of the nozzle on the arm, the tracer element may consistently be injected from the nozzle into the fluid flow column at an established proportional distance between the body member and the opposite side of the well. After the tracer element has been injected into the well, the appropriate detectors within the logging instrument may be utilized to determine the velocity and path of flow of the tracer element and, thereby, of the well fluid.

BRIEF DESCRIPTION OF THE DRAWINGS

FIGS. 2A–F comprise a side view, partially in cross-section of the tracer injector of the instrument of FIG. 1.

DETAILED DESCRIPTION OF THE PREFERRED EMBODIMENT

Figure 1:
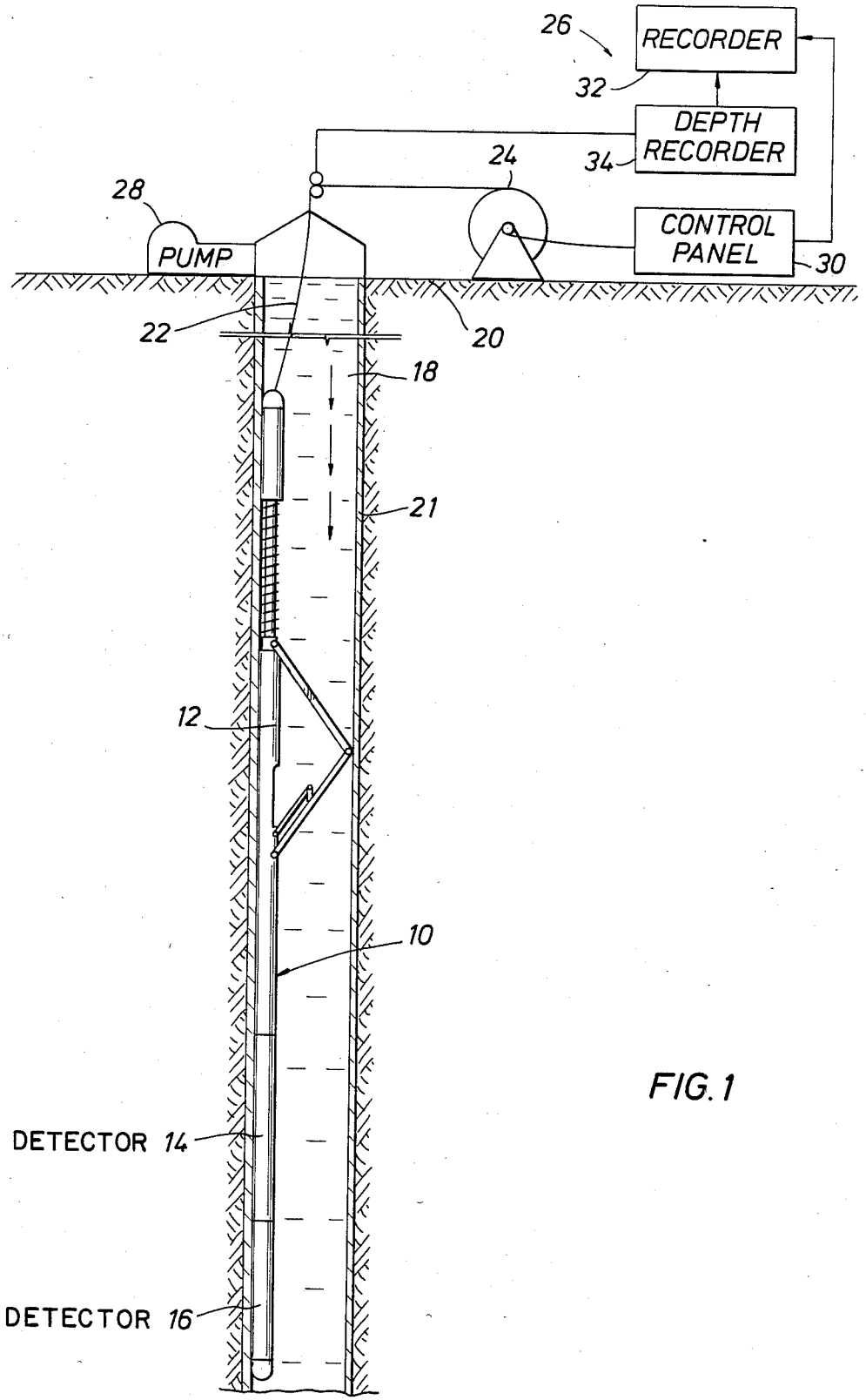
FIG. 1 is a side view of an instrument for determining fluid flow characteristics within a well in accordance with the present invention, in an intended operating configuration, shown disposed within a a well, illustrated in vertical section.
Figure 2C:
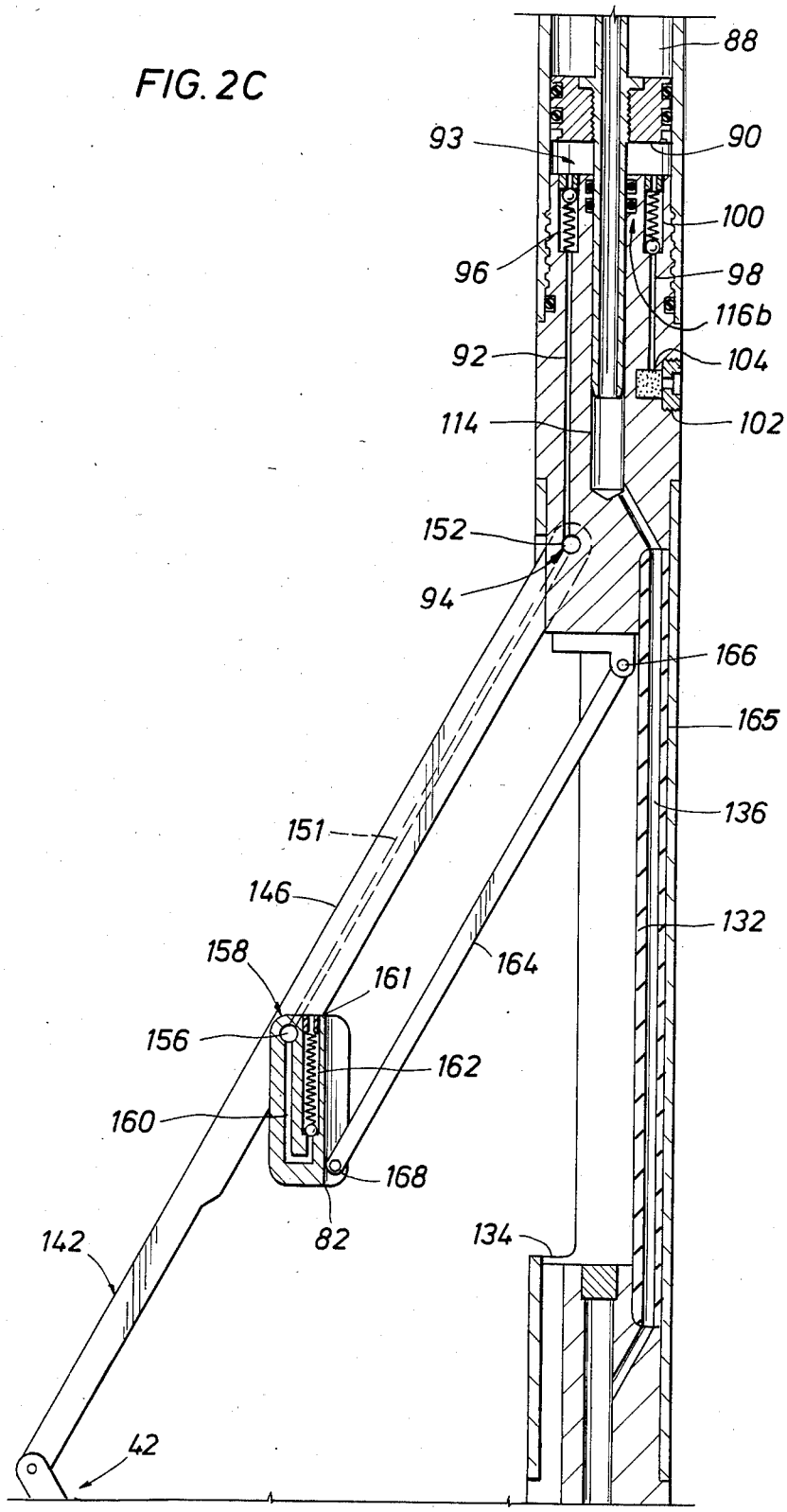
Figure 2D:
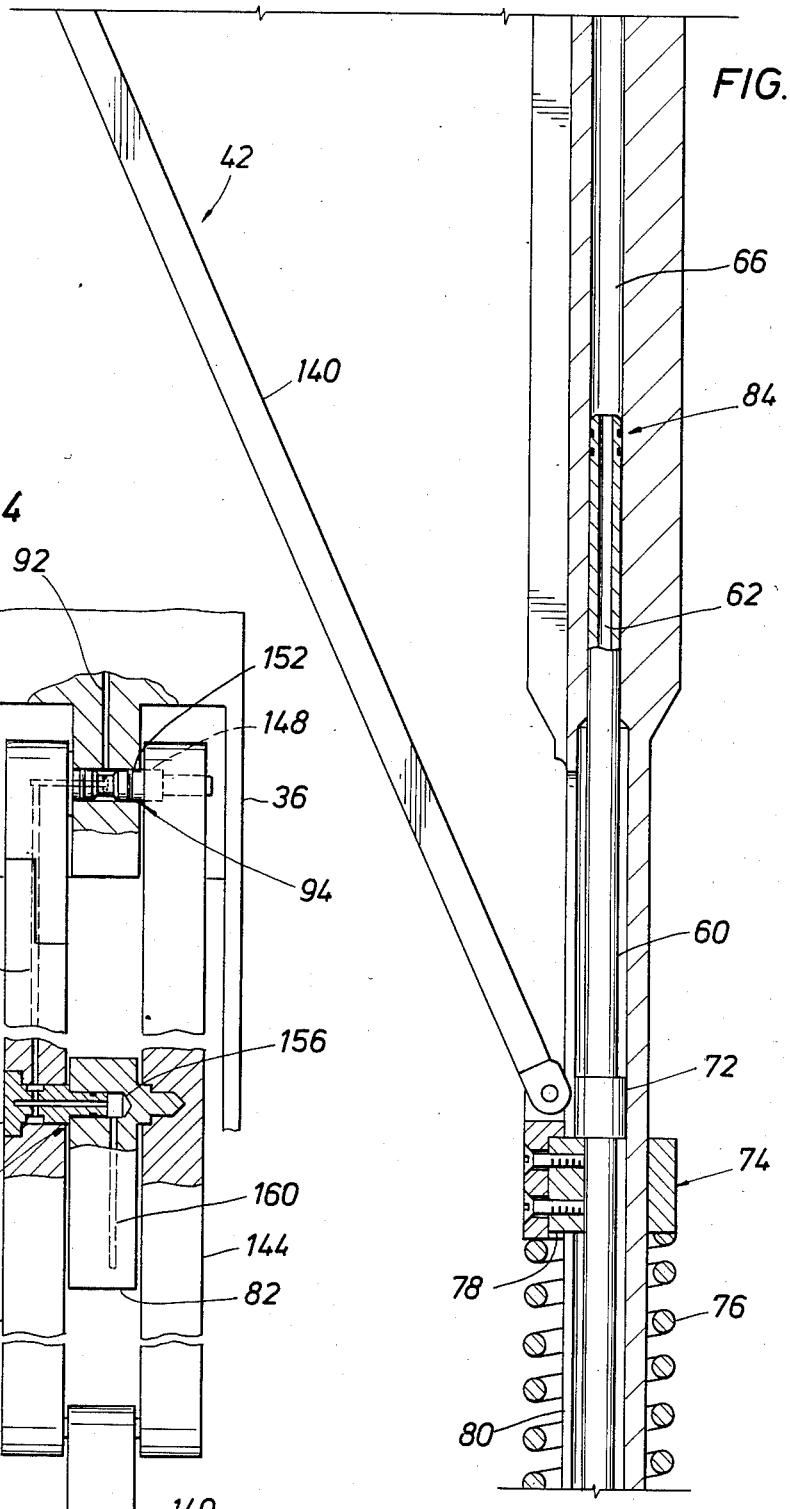

Referring now to the drawings in more detail, particularly to FIG. 1, therein is illustrated a logging instrument 10, including a tracer injector 12 in accordance with the present invention and two detectors 14 and 16 attached to tracer injector 12 in an intended operating configuration, disposed within an earth borehole or well 18 penetrating a portion of the earth's surface 20. Although a well 18 in which casing 21 has been set is illustrated, it is to be understood that an instrument 10 including a tracer injector 12 in accordance with the present invention may also be employed in an uncased shell. A cable 22 attached to drum 24 at the earth's surface 20 suspends instrument 10 within well 18 and contains electrical conductors (not illustrated) for providing electrical communication between instrument 10 and the surface electronics, generally illustrated at 26. In a typical logging operation, cable 22 is wound on or unwound from drum 24, causing instrument 10 to traverse well 18 in a manner known to the art. Surface electronics 26 includes a control panel 30 containing electronic circuitry suitable for generating command signals as are required to operate tracer injector 12 and also containing such electronic circuitry as necessary for processing electrical signals from detectors 14 and 16 and for communicating these signals to recorder 32. As instrument 10 is caused to traverse well 18, depth recorder 34 determines the longitudinal movement of instrument 10 within well 18 and generates electrical signals representative of such movement which are also communicated to recorder 32 facilitating the plotting of data represented by the electrical signals from detectors 14 and 16 relative to the depths at which the data was obtained.

Also illustrated at the earth's surface 20 is pump 28 as utilized with an injection well wherein fluids are pumped into the well to stimulate production in nearby wells. Because in the illustrated example fluid will be pumped into well 18 and will therefore be flowing toward the bottom of well 18, tracer injector 12 is attached above detectors 14 and 16 so that the tracer element released by tracer injector 12 will be carried past detectors 14 and 16 by the fluid flow. It is to be understood that if well 18 were a producing well, with fluid flowing from well 18 toward the earth's surface 20, instrument 10 would preferably be inserted in well 18 longitudinally reversed from the position illustrated. Tracer injector 12 would then lie below detectors 14 and 16 within the well so that the fluid flow within the well would still carry the tracer element from tracer injector 12 past detectors 14 and 16.

In one intended type of logging operation, tracer injector 12 will be utilized to inject a suitable radioactive element such as, for example, iodine-131 or iridium-192 into the well fluid. This radioactive element will preferably be dissolved within a sample of the well fluid to form a tracer element which will flow in coordination with the well fluid. Where a radioactive tracer element is to be injected into the well fluid, detectors 14 and 16 will include suitable radiation sensing devices (not illustrated) as are known in the art, for example, geiger counter tubes or scintillation counters, for detecting the tracer element in the manner required by the logging operation being conducted. It is to be understood that each detector will further contain such electronic power supplies and circuitry (not illustrated) as are conventional in the art and as are necessary for the operation of the radioactive sensors contained therein. It is further to be understood that although the use of a radioactive tracer element and radiation detectors have been described, the use of alternative types of tracer elements and sensors, for example, thermal tracer elements and appropriate temperature sensors, in conjunction with the tracer injector of the present invention is contemplated.

Referring now to FIGS. 2A–F of the drawings, therein is illustrated tracer injector 12, shown in operating configuration and illustrated partially in cross-section. Tracer injector 12 includes and is constructed upon an elongated body member 36 suitably adapted to traverse a borehole or well. Tracer injector 12 contains an electronics section 38 including suitable electronic power supplies and switching circuitry for controlling first and second drive systems 40 and 52 in response to command signals generated in the surface electronics (illustrated at 26 in FIG. 1). First drive system 40 operates to extend articulating arm assembly 42 relative to body member 36 and may be of any suitable type known to the art, but preferably is an electro-mechanical system including a reversible electric motor 44 suitably coupled through a gear box 46 to rotate a drive screw 48 and thereby move a screw follower 50 longitudinally within body member 36. The aforementioned components of first drive system 40 are preferably mounted within a hollow cylinder or tube 54 containing a longitudinal slot 56. A guide member 58 coupled to screw follower 50 is slidably engaged with slot 56, thereby restricting the movement of screw follower 50 to translation within body member 36.

Coupled to first drive system 40 is a first end of first pull rod 60 which is an elongated, generally cylindrical member having an aperture 62 proximate the longitudinal axis thereof, such aperture 62 extending from an area proximate the first end of first pull rod 60 to the second end thereof, and further having a through hole 64 proximate such first end providing access to aperture 62 from the exterior of first pull rod 60. First pull rod 60 extends longitudinally through aperture 66 in body member 36 and is adapted to move in translation therein. Because first pull rod 60 may extend through body member 36 for a significant distance, for example eighteen to twenty-two inches, in the preferred embodiment, bushings 68 and 70 are installed within aperture 66 concentric to first pull rod 60 to prevent excessive flexing thereof.

Arm carrier assembly 174 is located concentric to body member 36 and includes a shoulder 78 slidably engaged with a longitudinal slot 80 in body member 36 such that shoulder 78, and thereby arm carrier assembly 74, may move only in translation proximate first pull rod 60, one bound of such translational movement being rigidly established by stop 72 affixed to first pull rod 60 proximate the second end thereof. Arm carrier assembly 74 is biased against stop 72 by coil spring 76 also located concentric to body member 36.

It will be noted that first pull rod 60 preferably extends through aperture 66 in body member 36 for such distance that the second end of first pull rod 60 will be restricted within aperture 66 regardless of the position to which first pull rod 60 is moved by first drive system 40. Because when tracer injector 12 is placed within a well, slot 80 will place aperture 66 in fluid communication with the well, it is preferable to provide an occlusive seal around first pull rod 60 on each side of slot 80, preferably by means of o-ring pairs 84 and 86 installed in a conventional manner concentric to first pull rod 60 in aperture 66.

Articulating arm assembly 42 supporting injector nozzle 82 is pivotally coupled at a first end to slidable arm carrier assembly 74 and is pivotally coupled at a second end to body member 36. Articulating arm assembly 42 and the attachment thereof to body member 36 will be described in more detail later herein. Body member 36 preferably contains a generally longitudinal recess 134 located in body member section 165 adjacent to articulating arm assembly 42, such recess 134 suitably formed to allow the retraction of articulating arm assembly 42 generally within the diametrical confines of body member 36.

Located within body member 36 is a generally cylindrical chamber 88 for containing the tracer element to be injected into the well. A piston 90 is longitudinally slidable within chamber 88 and is sealingly engaged therewith for facilitating the expulsion of the tracer element from chamber 88. A first passage 92 is located within body member 36 proximate a first end 93 of chamber 88 providing fluid communication with fluid communicative coupling 94. A check valve 96, preferably having a forward flow release pressure of approximately forty psig is located in passage 92 allowing fluid passage out of chamber 88. A second passage 98 is also located in body member 36 proximate the first end 93 of chamber 88, such second passage 98 containing a check valve 100 having a forward flow release pressure of about five psig situated to allow the passage of fluid from fill port 102 into chamber 88. Fill port 102 preferably contains a filter 104 suitable to collect particulate matter which might impede the operation of check valves 96 and 100. Proximate a second end 95 of chamber 88 are passages **106*a* and 106*b* providing fluid communication between ports 108*a* and 108*b* and chamber 88. Ports 108*a* and 108*b* also preferably include filters 110*a* and 110*b* to prevent the entry of particulate matter of excessive size, for example, over fifteen to twenty-five microns in diameter, into chamber 88. Piston 90, which is suitably attached to second pull rod 112 so as to be moved longitudinally within chamber 88 thereby, prevents fluid communication between first end 93 and second end 95 of chamber 88**.

Second pull rod 112 is formed comparably to first pull rod 60 described earlier herein and is similarly coupled at a first end to second drive system 52 which is adapted to move second pull rod 112 longitudinally within chamber 88 and aperture 114 in body member 36. An occlusive seal is preferably provided around second pull rod 112 on each end of chamber 88 by pairs of o-rings 116*a* and 116*b* installed in a conventional manner concentric to second pull rod 112 within aperture 114. Second drive system 52 is preferably an electromechanical system of the type described previously herein with respect to first drive system 40.

It will be appreciated that a path is provided within tracer injector 12 for placement of electrical conductors to communicate electrical signals from either end of tracer injector 12 to the other end thereof and from either of such ends to electronics section 38. Such electrical conductors may be routed from electrical connector 118 at the second end of tracer injector 12, through aperture 120 in bulkhead 122, around second drive system 52 by means of a longitudinal aperture 124 in tube 126. The conductors may then enter through-hole 128 in second pull rod 112 and traverse aperture 130 therethrough, then traversing the remaining portion of aperture 114 in body member 36. A pressure vessel 132 adapted to withstand the pressures of a subsurface environment is located in recess 134 within body member 36 and sealingly engaged therewith, pressure vessel 132 containing a passage 136 joining aperture 114 with aperture 66 through which the conductors may pass, thereafter traversing aperture 62 and through-hole 64 in first pull rod 60, passing first drive system 40 through a longitudinal aperture (not illustrated) in tube 54 and terminating at electrical connector 138 at the first end of tracer injector 12. It is clear that conductors may be coupled to first and second drive systems 40 and 52 from either of electrical connectors 118 or 138 as necessary.

Figure 4:
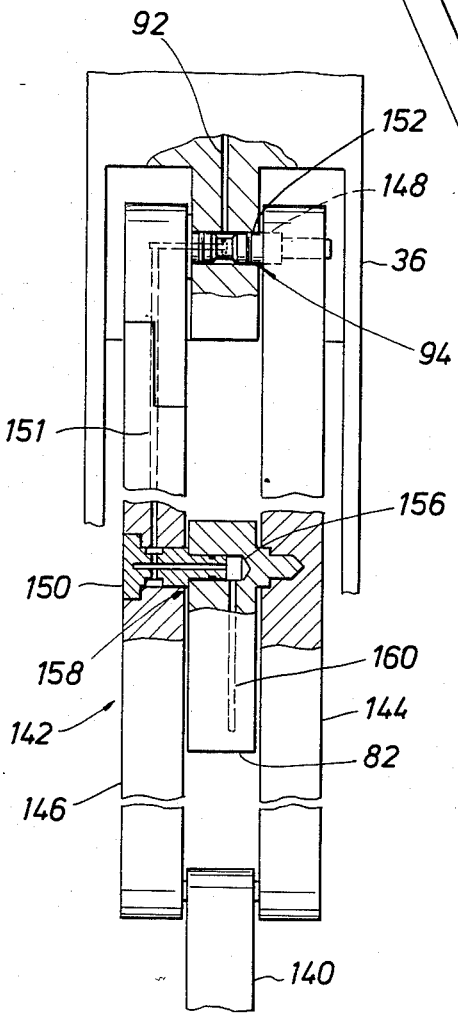
FIG. 4 is a detailed view, partially in cross-section, of the articulating arm assembly of FIG. 3.
Figure 2E:
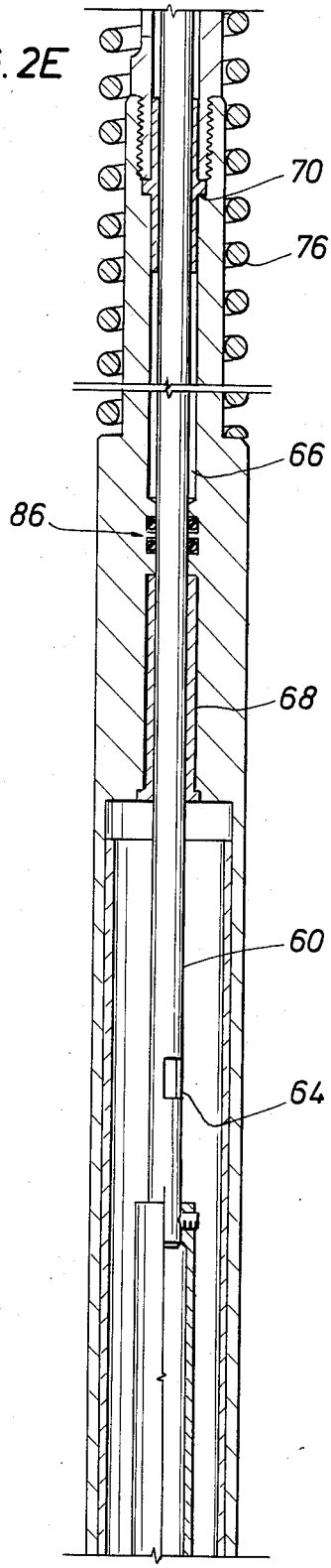
Figure 2F:
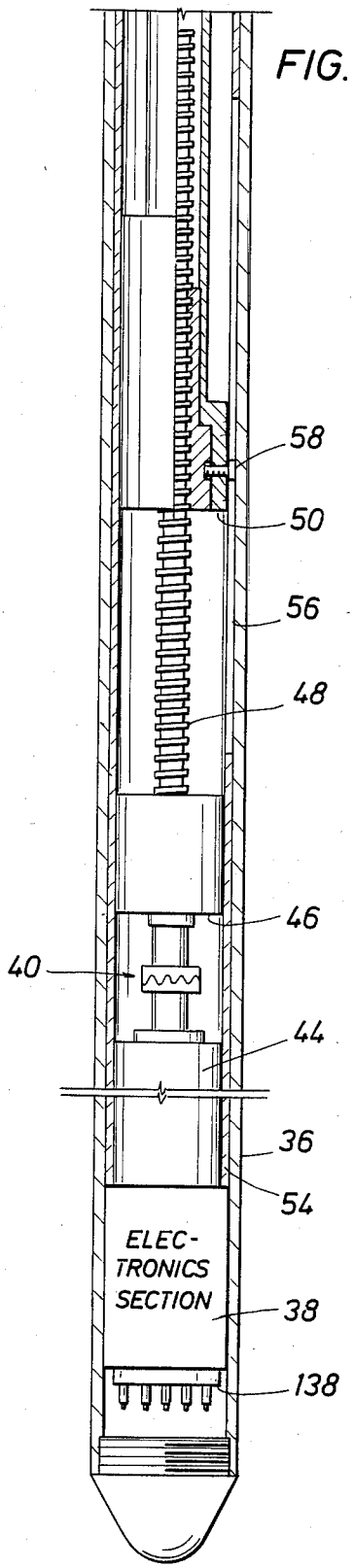
Figure 3:
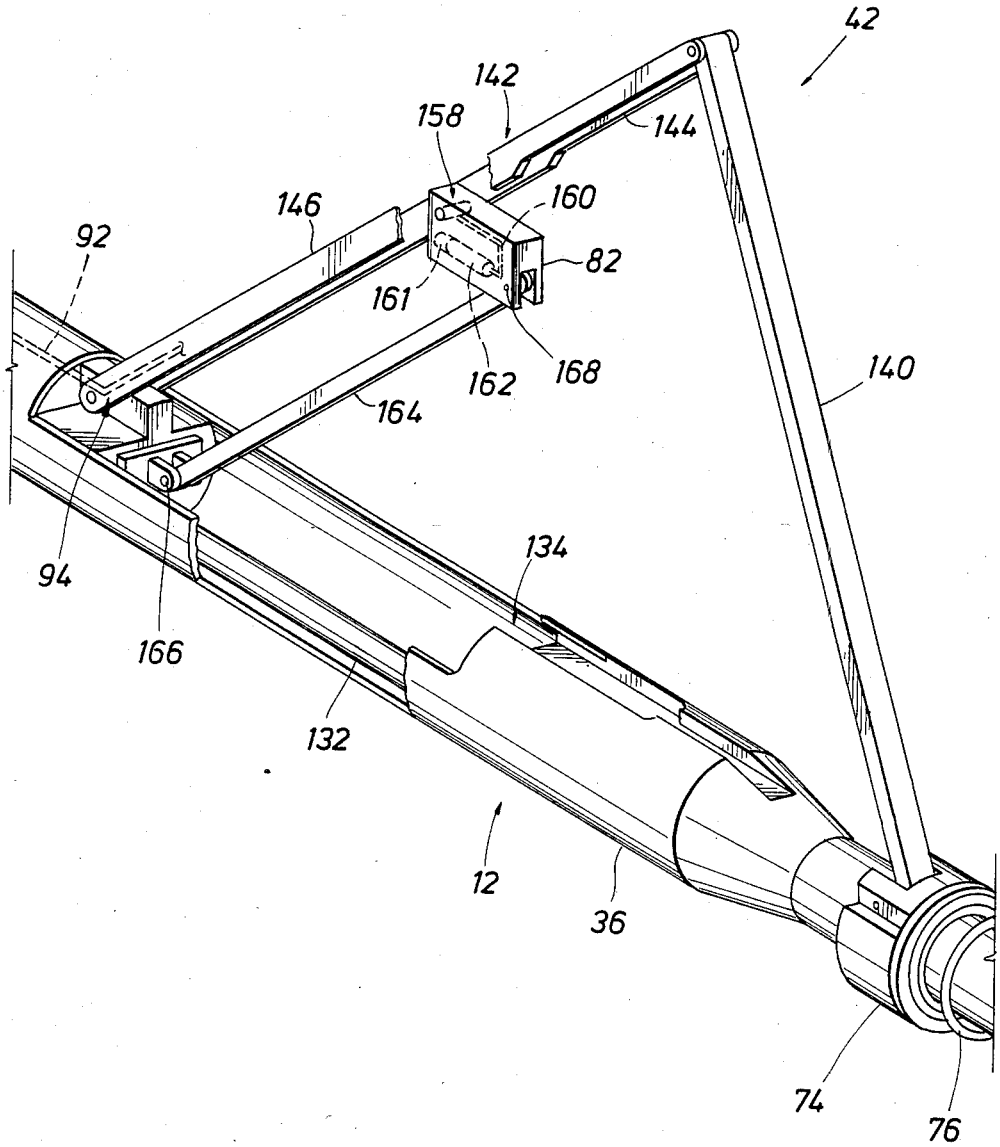
FIG. 3 is an isometric view of the articulating arm assembly of the tracer injector of FIG. 1.

Referring now to FIGS. 3 and 4 of the drawings, therein is shown in FIG. 3 in greater detail, and in isometric view, articulating arm assembly 42 of tracer injector 12, while in FIG. 4 is shown in greater detail articulating arm assembly 42, illustrated partially in cross-section. Pivotally coupled to arm carrier assembly 74 is a first end of drive arm 140. Drive arm 140 is an essentially linear member having a second end pivotally coupled to injector arm assembly 142. Injector arm assembly 142 preferably includes two generally linear members 144 and 146, one of which, 146, contains two fluid communicative weldments 148 and 150 and a passage 151 providing fluid communication therebetween. First weldment 148 is engaged with an aperture 152 and passage 92 in body member 36 to provide a fluid communicative coupling 94 therewith. Second weldment 150 engages an aperture 156 and passage 160 in injector nozzle 82 to provide a similar fluid communicative coupling 158. Passage 160 in injection nozzle 82 extends from fluid communicative coupling 158 to a fluid exit aperture 161 and contains a check valve 162, installed to allow fluid to exit injector nozzle 82 through exit aperture 161, such check valve 162 preferably having a forward flow release pressure of approximately 20 psig. The portion of passage 160 adjoining exit aperture 161 will preferably be generally parallel with the longitudinal axis of body member 36 so as to optimize the injection of the tracer element directly into the desired portion of the longitudinal fluid flow column when tracer injector 12 is operated within a well. In the preferred embodiment, injector nozzle 82, and thereby passage 160, are maintained in the desired parallel axial relation to body member 36 by a locating arm 164. Locating arm 164 is a generally linear member pivotally coupled to both injector nozzle 82 and body member 36 such that the points of such pivotal attachments 166 and 168 viewed in conjunction with fluid communicative couplings 94 and 158 define the corners of a parallelogram.

Injection nozzle 82 is preferably coupled to injector arm assembly 142 proximate the longitudinal midpoint thereof. This placement of injector nozzle 82 insures that when tracer injector 12 is placed within a well the tracer element may be released proximate the center of the fluid column flowing by tracer injector 12 essentially regardless of the diameter of the well in which tracer injector 12 is operated. Note that injector nozzle 82 may be coupled to injector arm assembly 142 away from the midpoint thereof to facilitate placement of the tracer element at a different proportional location across the described fluid column. It will be appreciated that the present invention also contemplates the use of a plurality of injector nozzles coupled to injector arm assembly 142 along the length thereof to facilitate a greater dispersion of the tracer element within the fluid flow column. Further, the present invention also contemplates the use of one or more injector nozzles each of such nozzles having a plurality of apertures through which the tracer element may exit the nozzle so as to further facilitate such dispersion.

Referring now to the figures generally, in the preferred operation of tracer injector 12, prior to insertion of tracer injector 12 into the well, chamber 88 thereof must be filled with the tracer element. To fill chamber 88, second drive system 52 is activated to drive piston 90 to first end 93 of chamber 88. A column of the tracer element is supported above fill port 102 while second drive system 52 is then activated in the reverse direction to draw piston 90 back toward second end 95 of chamber 88 and to thereby draw the tracer element into chamber 88. To prepare tracer injector 12 for insertion into the well, first drive system 40 is activated to draw first pull rod 60 away from the midpoint of tracer injector 12, causing stop 72 to move arm carrier assembly 74 along body member 36 against the compression of coil spring 76 and thereby retract articulating arm assembly 42 within recess 134 in body member 36. Detectors 14 and 16 may be appropriately coupled to tracer injector 12 and instrument 10, composed of tracer injector 12 and detectors 14 and 16, is then ready to be introduced into well 18.

Instrument 10 is lowered into well 18 to a depth horizon at which the tracer element is to be injected into the fluid flow. A first command signal generated within control panel 30 is used to activate first drive system 40 to move first pull rod 60 with stop 72 toward the midpoint of tracer injector 12. Coil spring 76 biases arm carrier 74 toward the midpoint of body member 36 causing articulating arm assembly 42 to extend generally laterally relative to body member 36. As articulating arm assembly 42 extends, it contacts well casing 21, and, through the force exerted by coil spring 76, biases body member 36 against the opposing side of well casing 21, as shown in FIG. 1. The movement of arm carrier 74 will cease as either articulating arm assembly 42 fully biases body member 36 against well casing 21 or arm carrier assembly 74 contacts stop 72 on first pull rod 60.

A second command signal is then generated within control panel 30, activating second drive system 52 for an established period of time. Second drive system 52 moves second pull rod 112 toward the midpoint of body member 36, thereby moving piston 90 toward first end 93 of chamber 88 for the established time increment. As piston 90 compresses the tracer element within chamber 88, check valve 100 prevents the escape of any fluid out passage 98 and fill hole 102. Therefore, the pressure upon the tracer element builds until the forward flow release pressure of check valve 96 within passage 92 is achieved, whereupon the tracer element will flow through passage 92, through fluid communicative coupling 94 into passage 151 in injector arm assembly 42, and through fluid communicative coupling 158 into passage 160 in injector nozzle 82. The fluid then flows out past check valve 162 and into the well fluid flow regime for so long as piston 90 is moved by second drive system 52. As piston 90 moves toward first end 93 of chamber 88, well fluid will be drawn into chamber 88 through ports 108*a* and 108*b* and passages 106*a* and 106*b*, thereby avoiding the creation of a vacuum behind piston 90 as it expells the tracer element from chamber 88. When second drive system 52 is deactivated, as the pressure on the tracer element falls, check valve 96 will close, stopping the flow of fluid into passage 92. Similarly, as check valve 96 closes and the pressure on the tracer element in passage 92 ceases, check valve 162 in injector nozzle 82 will close to prevent the tracer element from being drawn from injector nozzle 82 by the venturi effect of the well fluid passing thereby. The tracer element may then be detected as the well fluid flow carries it past detectors 14 and 16 within well 18. When such detection is completed, first drive system 40 may then be activated in the reverse direction from that last employed so as to retract arm carrier 74 along body member 36 and thereby retract articulating arm assembly 42 back within recess 134. Instrument 10 may then be moved within well 18 to any other depth horizon at which a measurement is desired.

Many modifications and variations besides those specifically mentioned may be made in the techniques and structures described herein and depicted in the accompanying drawings without departing substantially from the concept of the present invention. For example, in place of the articulating arm assembly described, a single arm may be extended from the body member to support an injector nozzle or an equivalent thereof and/or to decentralize the body member against the side of the well bore. Further, a plurality of arms or articulating arms may be coupled to the body member and extended simultaneously to maintain the tracer injector centralized within the well while allowing the tracer element to be injected into the annulus between the body member and the inner surface of the well. Accordingly, it should be clearly understood that the forms of the invention described and illustrated herein are exemplary only and are not intended as limitations on the scope of the present invention.

The embodiments of the invention in which an exclusive property or privilege is claimed are defined as follows:

1. An apparatus for use in evaluating fluid flow rates within a well traversing subsurface earth formations, comprising:

an elongated housing member;

at least one support member coupled to said housing member and selectively extendable therefrom; and means for controllably releasing a tracer substance into said well fluid flow in a generally longitudinal path generally parallel to the longitudinal axis of said housing member, said releasing means supported adjacent said housing member by said support member.

2. The apparatus of claim 1, wherein said support member comprises:

an articulating arm, pivotally coupled at each end to said housing member, at least one of said ends of said articulating arm also slidably coupled to said housing member.

3. The apparatus of claim 1, further comprising:

means for containing said tracer substance to be released into said well; and means for providing a path of fluid communication between said containing means and said releasing means.

4. The apparatus of claim 3 wherein said releasing means comprises a nozzle pivotally coupled to said support member.

5. The apparatus of claim 1, further comprising extending means wherein said extending means comprises:

a drive member pivotally coupled to said support member; and means for extending said drive member and said support member relative to said housing member.

6. The apparatus of claim 5, further comprising means for retracting said support member radially in relation to said housing member.

7. A well logging apparatus for determining characteristics of the fluid flow within a well, comprising:

an elongated body member;

at least one support member coupled to said body member and radially extendable therefrom;

means for injecting a quantity of tracer element into said fluid flow within said well from at least one position on said support member, said tracer element injected in a path adjacent and generally parallel to said body member; and means contained on said body member for detecting said tracer element after said tracer element has been injected into said fluid flow.

8. The apparatus of claim 7, wherein said means for detecting said tracer element comprises a plurality of detectors suitable for detecting said tracer element, at least two of said plurality of detectors longitudinally spaced from one another along said body member.

* * * * *